US011499499B1

(12) United States Patent
Hoffman et al.

(10) Patent No.: US 11,499,499 B1
(45) Date of Patent: Nov. 15, 2022

(54) MARINE ENGINES, CYLINDER LINERS FOR MARINE ENGINES, AND METHODS AND ASSEMBLIES FOR FORMING MARINE ENGINES

(71) Applicant: Brunswick Corporation, Mettawa, IL (US)

(72) Inventors: Daniel P. Hoffman, Fond du Lac, WI (US); Alexander K. Monroe, Saint Cloud, WI (US); Clayton T. Rasmussen, North Fond du Lac, WI (US); Gregory Roberts, North Fond du Lac, WI (US); Dennis J. Stephany, Kiel, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 17/494,269

(22) Filed: Oct. 5, 2021

(51) Int. Cl.
*F02F 1/00* (2006.01)
*B22D 19/00* (2006.01)
*F02B 61/04* (2006.01)

(52) U.S. Cl.
CPC ..... *F02F 1/004* (2013.01); *B22D 19/0009* (2013.01); *F02B 61/04* (2013.01)

(58) Field of Classification Search
CPC ..... F02F 1/004; F02F 7/0095; F02F 7/0085; B22D 19/0009; B22D 17/2263; F02B 61/04; F02B 61/045; F02B 75/22; B63H 20/00; B22C 9/06; B22C 9/105
See application file for complete search history.

(56) References Cited

U.S. PATENT DOCUMENTS

| | | | | |
|---|---|---|---|---|
| 4,452,194 | A | 6/1984 | Watanabe | |
| 4,776,303 | A | 10/1988 | Hundertmark | |
| 5,134,976 | A | 8/1992 | Towner et al. | |
| 5,303,682 | A | 4/1994 | Donahue et al. | |
| 5,558,151 | A * | 9/1996 | Gilbert | B22D 17/24 164/334 |
| 7,000,584 | B1 | 2/2006 | Wynveen et al. | |
| 7,240,608 | B2 * | 7/2007 | Schaefer | F02F 1/004 29/888.061 |
| 10,233,862 | B1 * | 3/2019 | Hoffman | F02F 1/004 |
| 11,318,530 | B1 * | 5/2022 | Cleary | B22D 17/229 |
| 2006/0225688 | A1 * | 10/2006 | Ward | F02F 1/18 123/193.2 |

FOREIGN PATENT DOCUMENTS

| | | |
|---|---|---|
| EP | 0532331 | 3/1993 |

* cited by examiner

*Primary Examiner* — Syed O Hasan
(74) *Attorney, Agent, or Firm* — Andrus Intellectual Property Law, LLP

(57) ABSTRACT

A marine engine has a cylinder block defining at least one cylinder bore and a cylinder liner providing a running surface for a piston in the cylinder bore. The cylinder liner is non-axisymmetric relative to a center axis of the cylinder liner. The cylinder block defines a pocket that retains the cylinder liner and prevents the cylinder liner from rotating about the center axis. Novel cylinder liners, assemblies and methods are provided for forming a marine engine having the cylinder block with the cylinder liner formed therein.

20 Claims, 10 Drawing Sheets

MARINE ENGINES, CYLINDER LINERS FOR MARINE ENGINES, AND METHODS AND ASSEMBLIES FOR FORMING MARINE ENGINES

FIELD

The present disclosure relates to marine engines, cylinder liners for marine engines, and methods and assemblies for forming marine engines having cylinder liners that are formed-in-place with the marine engine.

BACKGROUND

The following patents are incorporated herein by reference, in entirety.

U.S. Pat. No. 10,233,862 discloses a marine engine having a cylinder block that defines a cylinder bore; a piston that reciprocates in the cylinder bore under force of combustion in the marine engine; and a cylinder liner disposed in the cylinder bore between the piston and the cylinder block. The cylinder liner provides a running surface for the piston. The cylinder liner has a cylindrical liner body that is sized to fit snugly within the cylinder bore and a pair of diametrically opposing tabs axially extends from liner body into the cylinder bore. Methods of making a marine engine are also disclosed.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

A marine engine has a cylinder block defining at least one cylinder bore and a cylinder liner providing a running surface for a piston in the cylinder bore. The cylinder liner is non-axisymmetric relative to a center axis of the cylinder liner. The cylinder block defines a pocket that retains the cylinder liner and prevents the cylinder liner from rotating about the center axis.

In non-limiting examples disclosed herein, the cylinder liner has liner body configured to fit in the cylinder bore, diametrically opposing first and second cylinder liner tabs that axially extend from an end the liner body, and a radial step that radially inwardly extends from the first cylinder liner tab. The radial step is configured to engage with a corresponding radial shoulder on a mandrel as the cylinder liner is slid onto the mandrel. Engagement between the radial step and the radial shoulder automatically clocks the cylinder liner into a predetermined orientation in the marine engine during formation thereof.

Assemblies are also herein disclosed for forming a marine engine. The assemblies can include a mold for forming the cylinder block of the marine engine, a mandrel configured for insertion into the mold prior to formation of the cylinder block so as to form a cylinder bore in the cylinder block, and a cylinder liner configured to provide a running surface for a piston in the cylinder bore. The cylinder liner is disposed on the mandrel during formation of the cylinder block in the mold. The cylinder liner and the mandrel are configured to engage with each other when the cylinder liner is slid onto the mandrel prior to formation of the cylinder block so as to automatically clock the cylinder liner into a predetermined orientation in the cylinder block during formation thereof.

Methods are also provided for forming a cylinder block of a marine engine, the method comprising providing a mold assembly for forming the cylinder block; providing a mandrel for forming a cylinder bore in the cylinder block; disposing a cylinder liner on the mandrel, the cylinder liner being configured to provide a running surface for a piston in the cylinder bore, the cylinder liner being further configured to engage with the mandrel as the cylinder liner is disposed on the mandrel so as to automatically clock the cylinder liner into a predetermined orientation in the cylinder block during formation thereof; and forming the cylinder block in the mold and around the mandrel and cylinder liner.

BRIEF DESCRIPTION OF THE DRAWINGS

Examples are described with reference to the following drawing figures. The same numbers are used throughout to reference like features and components.

DETAILED DESCRIPTION

Figure 1:
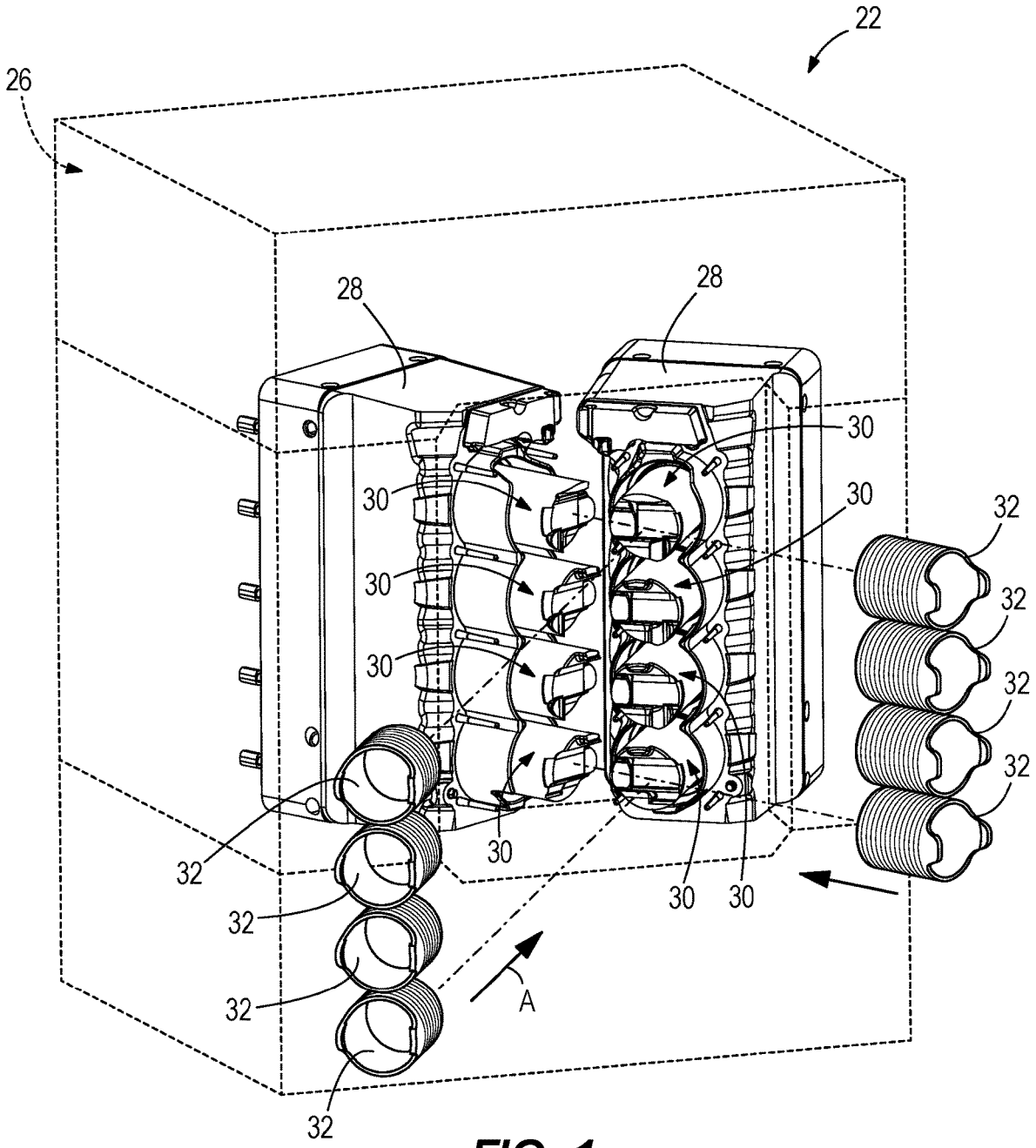
FIG. 1 is a perspective view of cylinder liners according to a first embodiment of the present disclosure being inserted onto mandrels in a mold assembly for forming a cylinder block of a marine engine.

The present disclosure relates to the field of marine engines, and particularly to apparatuses, assemblies and methods for making marine engines having cylinder blocks and particularly cylinder blocks having cylinder liners that provide a running surface for a piston in a cylinder bore of the cylinder block.

During research and experimentation, the present inventors determined that conventional methods of pressing cylinder liners into the bores of a cylinder block during formation thereof disadvantageously require costly machining operations that are prone to failure and/or downtime. Such prior art processes typically require heating of the block, pressing the cylinder liners into the block, and then cooling of the assembly. During cooling, differential expansion of the cylinder liners and cylinder block can cause the cylinder liners to lift relative to the head deck. After cooling, the cylinder liners need to be hammered into position. In addition, such conventional machining operations often disadvantageously expose leak paths which require impregnation prior to insertion of the cylinder liner.

During research and experimentation, the present inventors also determined that conventional methods for forming (e.g., casting) cylinder liners in place in the cylinder block are not particularly well suited for use with cylinder liners that are not axisymmetric, such as the cylinder liners disclosed in U.S. Pat. No. 10,233,862 having diametrically opposed tabs that axially extend from the liner body. With this type of cylinder liner, the present inventors determined it is necessary to maintain a certain rotational alignment of the cylinder liner during the forming process, in particular so that the tabs do not become deformed or broken when the forming dies are brought together. The present inventors found this to be especially challenging because the rotational position of the cylinder liner is prone to change during vibration and other movements of the forming dies and other components during the forming process.

The present disclosure is a result of the present inventors' realization of the above disadvantages in the prior art and their efforts to overcome these disadvantages. In particular, the present disclosure provides novel cylinder liners, novel marine engines having the cylinder liners formed in place, as well as novel methods and assemblies for forming the cylinder liners in place (e.g. during casting of the cylinder block) wherein a rotational orientation of each cylinder liner is precisely controlled during formation of the cylinder block.

The exemplary embodiments described and depicted herein teach methods and assemblies for forming aluminum cylinder blocks having port and starboard banks of cylinder bores that are angled towards each other in a V-shape; however it should be recognized that the concepts taught in the present disclosure are equally applicable to methods of making cylinder blocks of other types of metal and having any number of cylinder bores, for example but not limited to four, six, ten or twelve cylinders. Also, the inventive concepts taught in the present disclosure are equally applicable to methods of making cylinder blocks having an inline or any other cylinder bore configuration.

FIGS. 1-6 depict a mold assembly 22 for forming a V-shaped cylinder block 24 (see FIG. 7) of a marine engine. The mold assembly 22 includes among other things a movable forming die 26 comprised of several die portions which are brought together by conventional means to support a pair of tooling dies 28 in the position shown in FIG. 1. The tooling dies 28 are angularly oriented relative to each other in a V-shape, in particular for formation of the V-shaped cylinder block 24, as will be further described herein below. Each tooling die 28 has an aligned bank of four mandrels 30, which as further described herein below are specially configured support a corresponding set of novel cylinder liners 32, maintaining each in a desired clocked orientation throughout the forming process, including but not limited to during movement of the movable forming die 26 into engagement with a corresponding stationary forming die 36 (see FIG. 7) for formation of the cylinder block 24.

Referring to FIGS. 2-6, each cylinder liner 32 extends along a center axis 33 (see FIG. 5) and has an axially-elongated cylindrical liner body 34 which is configured to fit in a cylinder bore 27 (see FIG. 7) of the cylinder block 24 and provide a running surface for a piston. The liner body 34 has a first axial end 40 and an opposing second axial end 41. Diametrically opposing first and second cylinder liner tabs 38 extend axially outwardly from the first axial end 40. Each of the first and second cylinder liner tabs 38 has an end surface 46 and opposing side surfaces 48 that curve away from the end surface 46 to the first axial end 40 of the liner body 34. The shape of the first and second cylinder liner tabs 38 can vary from what is shown. As such, the cylinder liner 32 is not axisymmetric. First and second radial steps 42, which in the illustrated example are ledges, extend radially inwardly from the first and second cylinder liner tabs 38, respectively. The first radial step 42 extends along an inner diameter of the first cylinder liner tab 38, and the second radial step 42 extends along an inner diameter of the second cylinder liner tab 38. In the embodiment shown in FIGS. 1-6, the first and second radial steps 42 extend to and between the opposing side surfaces 48 of the respective first and second cylinder liner tab 38. The first and second cylinder liner tabs 38 and the first and second radial steps 42 are mirror images of each other, however it is possible to accomplish the objectives of the present invention with a cylinder liner having only one cylinder liner tab or with a cylinder liner having cylinder liner tabs that are not diametrically opposite each other and/or are not mirror images of each other.

Figure 2:
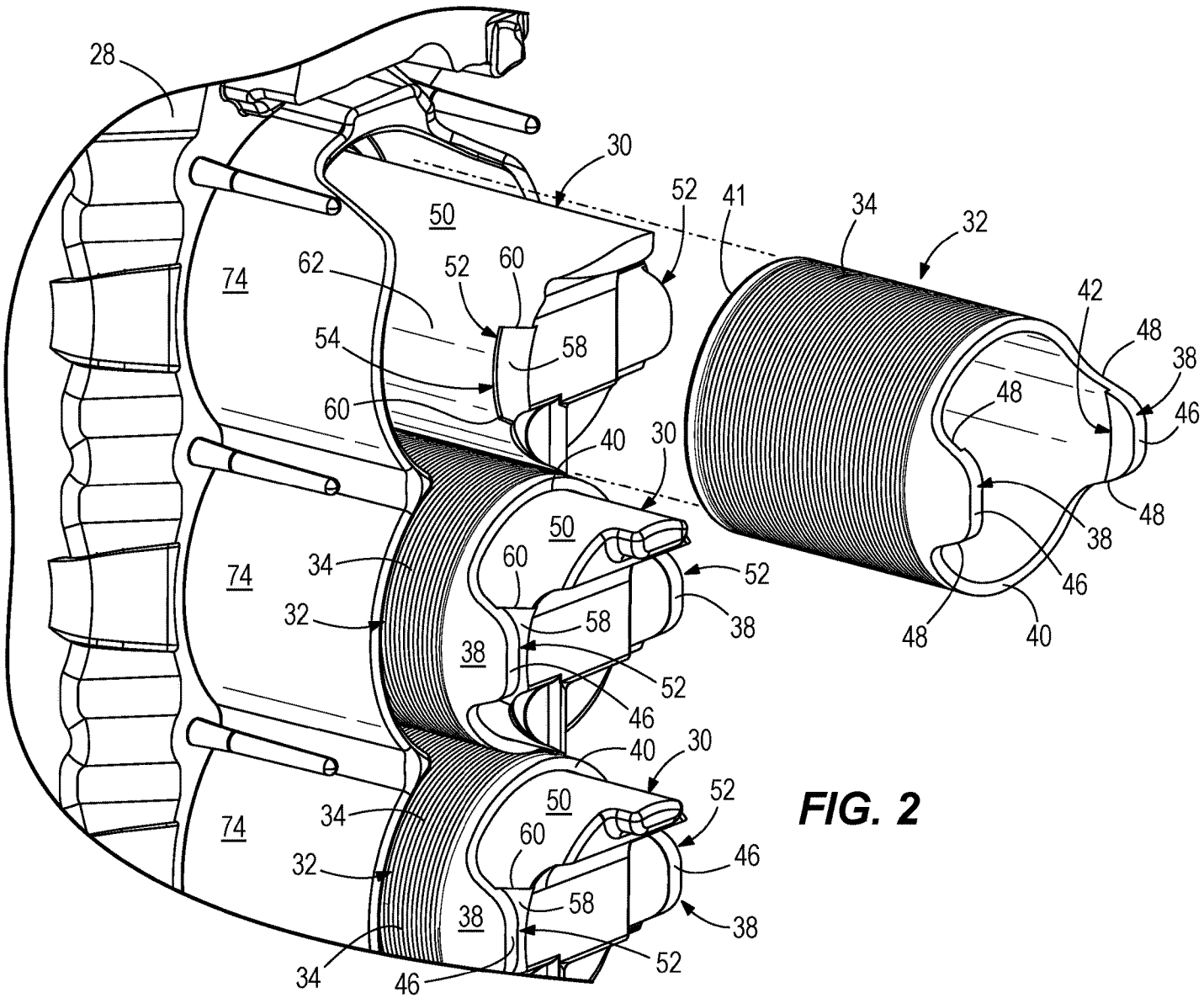
FIG. 2 is a closer perspective view of the cylinder liners and mandrels.
Figure 3:
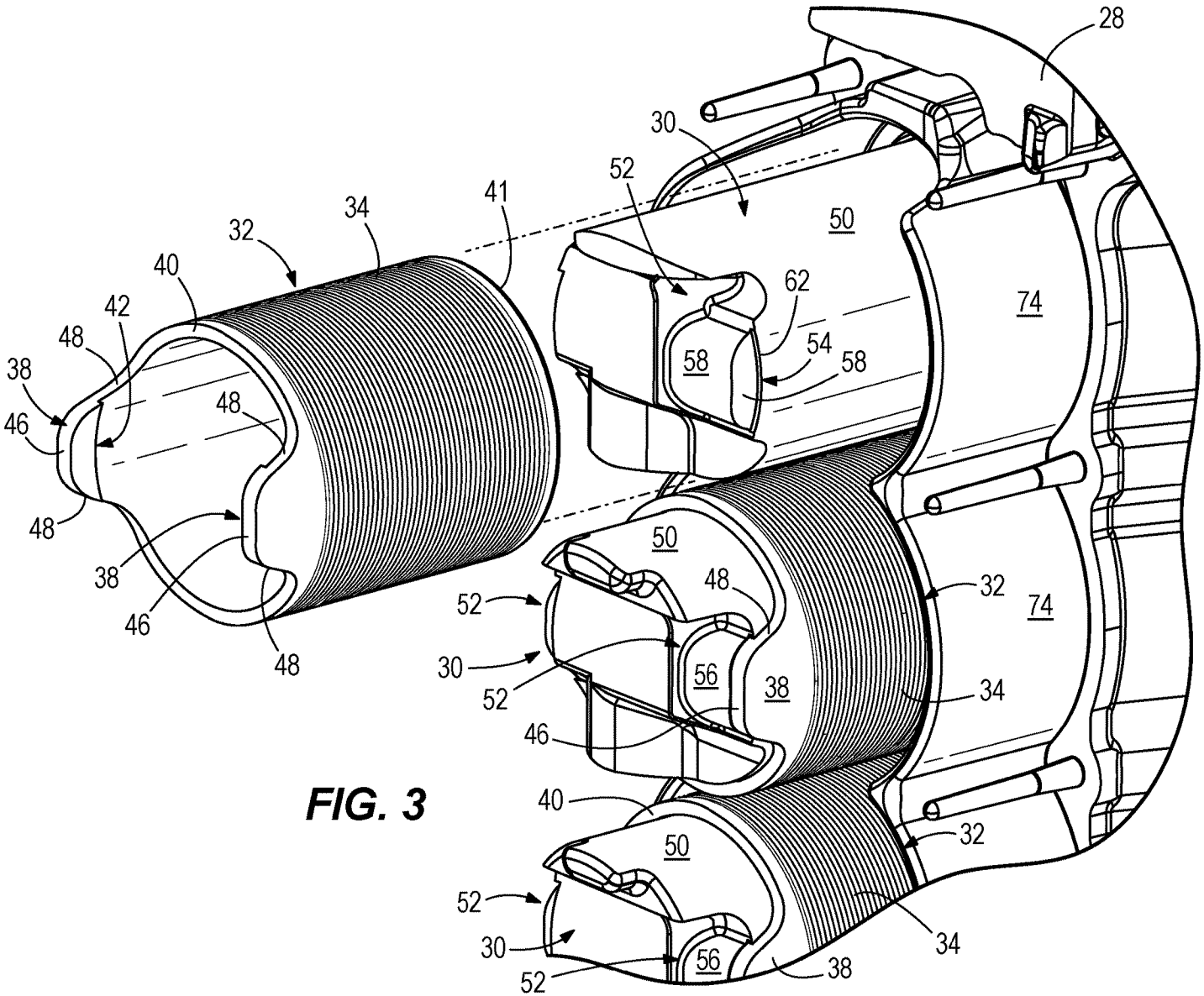
FIG. 3 is an opposing closer perspective view of the cylinder liners and mandrels.

Each mandrel 30 has a generally cylindrical mandrel body 50 with an outer diameter sized slightly smaller than the inner diameter of the cylinder liner 32, so that the cylinder liner 32 can be axially slid onto the mandrel 30 during formation of the cylinder block 24, as shown by arrow A and the dash-and-dot lines in FIGS. 1-3. Each mandrel 30 has opposing first and second diametrically opposing and non-symmetrical head portions 52 having opposing first and second radially outwardly projecting radial shoulders 54, respectively, which in the illustrated example are ledges. As will be further described herein below, the first and second radial shoulders 54 are configured to engage with the first and second inwardly projecting radial steps 42 on the first and second cylinder liner tabs 38 as the cylinder liner 32 is slid onto the mandrel 30. See the dashed line in FIG. 6. The first and second head portions 52 have a shape that generally corresponds to the first and second cylinder liner tabs 38, including a rounded or domed top surface 56 and a radially outwardly-facing beveled surface 58 that axially extends from the domed top surface 56, radially tapering outwardly to the first and second radial shoulders 54. The shape of the first and second head portions 52 can vary from what is shown. The first and second radial shoulders 54 each have a pair of opposing side surfaces 60 and a bottom surface 62 that extends between the side surfaces 60. The side surfaces 60 taper inwardly towards each other and towards the bottom surface 62. As will be further described herein below, the radially outwardly-facing beveled surfaces 58 and the side surfaces 60 funnel the cylinder liner 32 into a desired clocked orientation as the cylinder liner 32 is slid onto the mandrel 30 and thereafter the side surfaces 60 restrain the cylinder liner 32 from rotational movement relative to the center axis 33 during movement of the forming die 26. In the illustrated embodiment, the first and second head portions 52 have first and second radial shoulders 54 that are not mirror images of each other, particularly in that some features such as the side surfaces 60 of the respective first and second radial shoulders 54 are sized differently. However in other examples the first and second head portions 52 and first and second radial shoulders 54 can be mirror images of each other.

Figure 4:
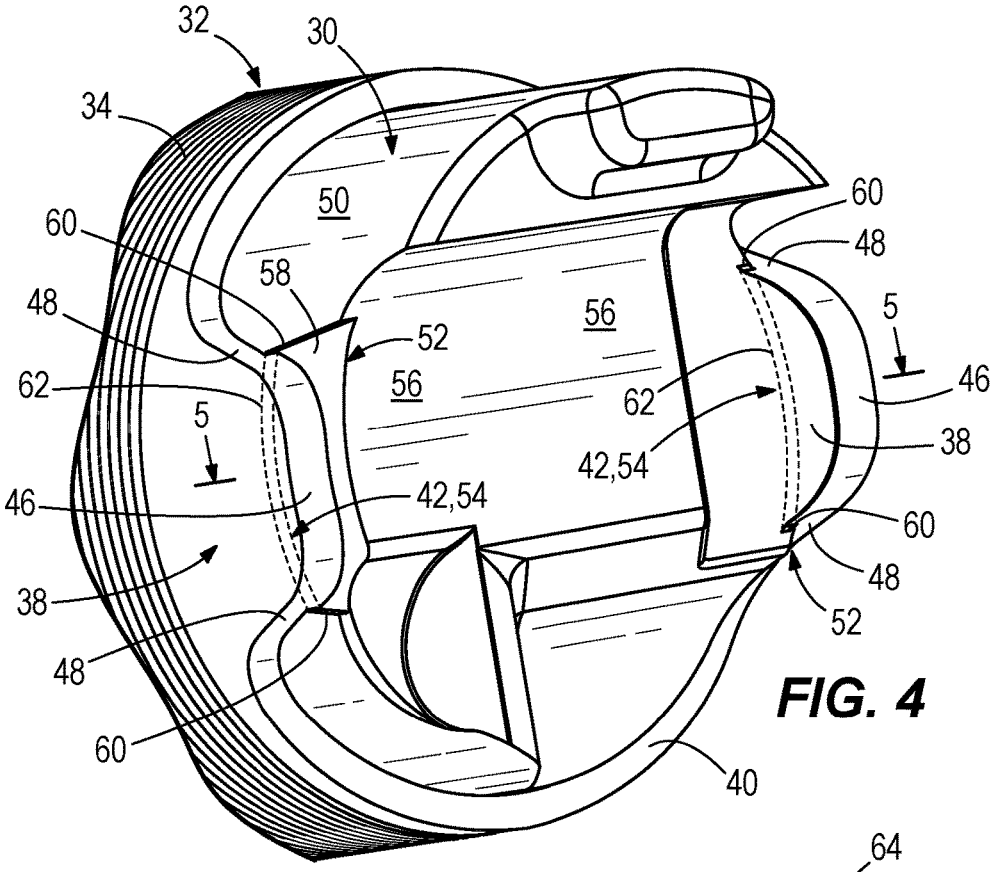
FIG. 4 is a perspective end view showing engagement between a cylinder liner and mandrel in dashed lines.
Figure 5:
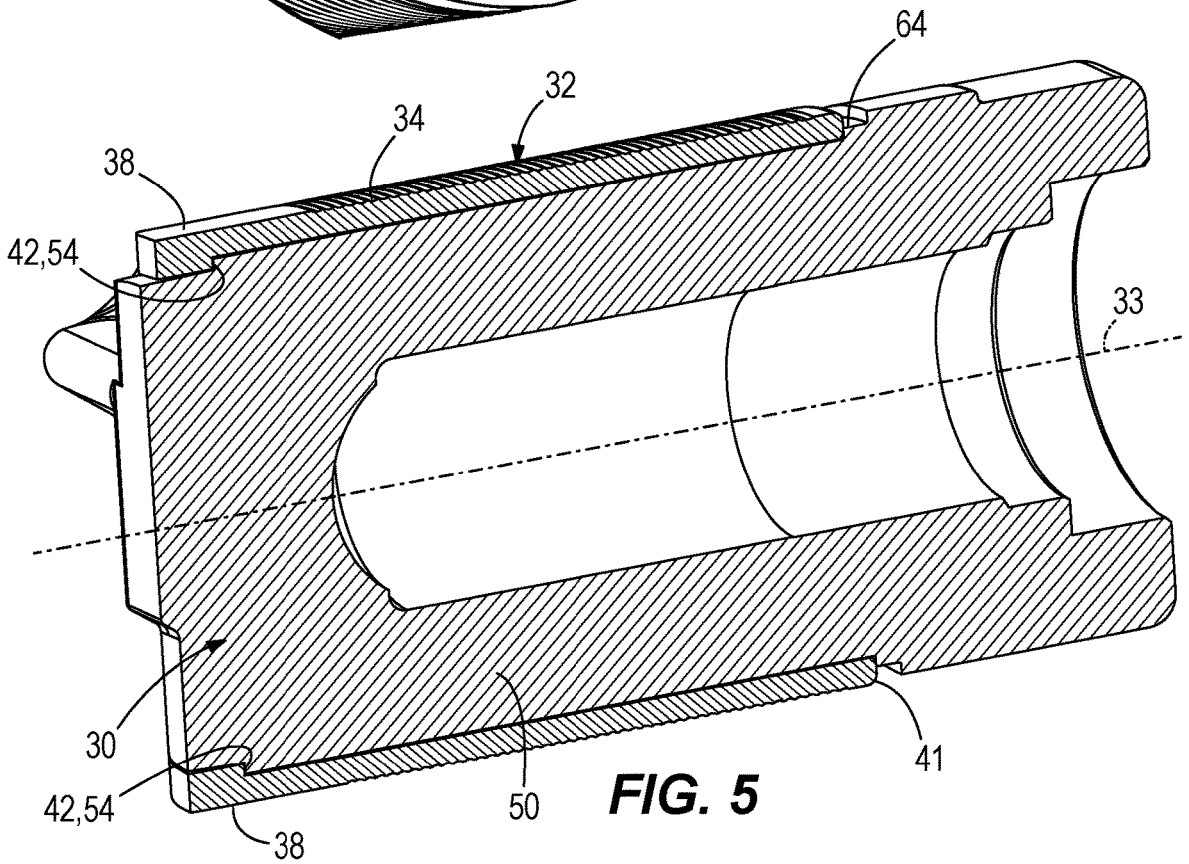
FIG. 5 is a view of section 5-5, taken in FIG. 4.
Figure 6:
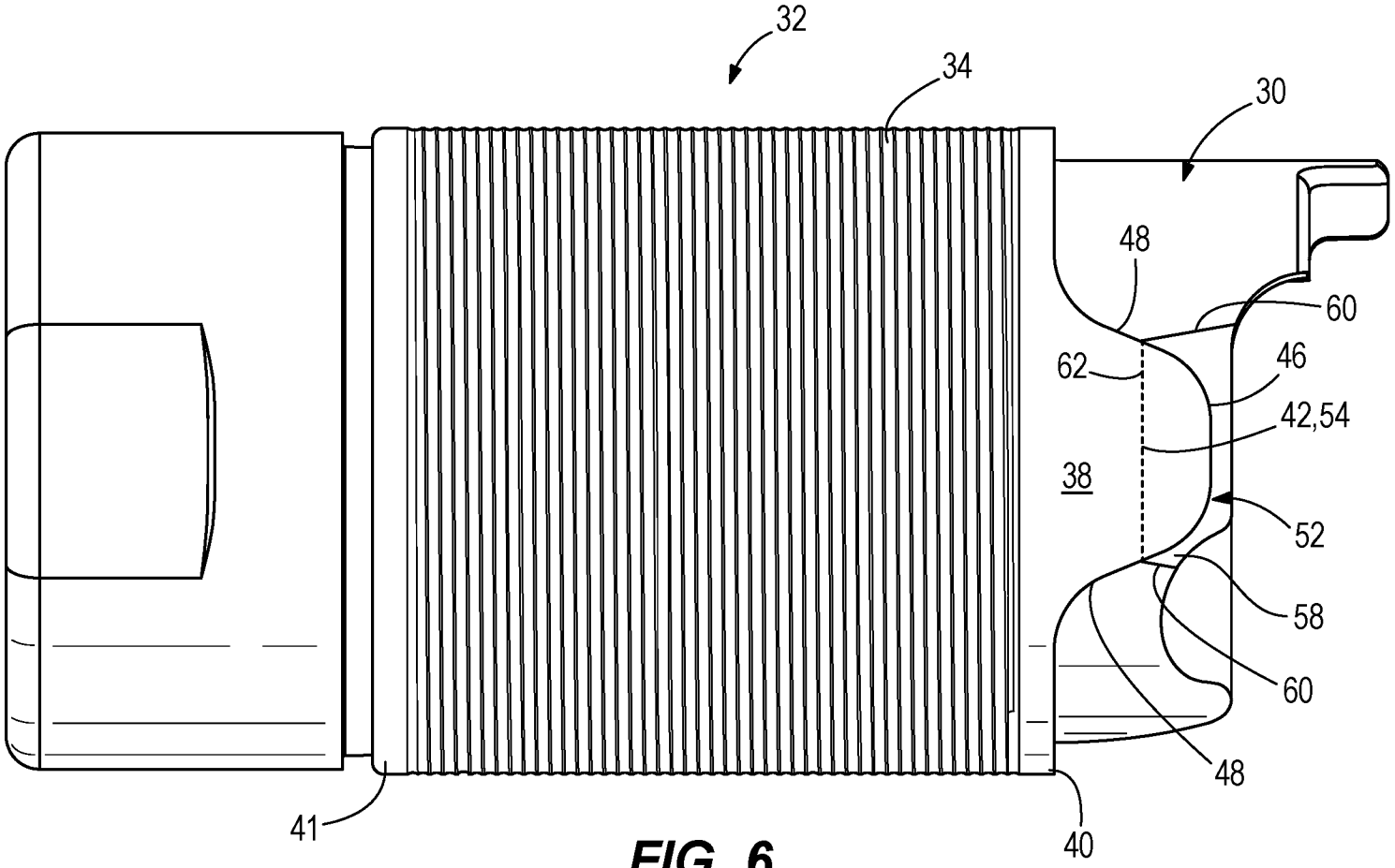
FIG. 6 is a plan view of a cylinder liner on a mandrel.

With reference to FIGS. 1-3, the mold assembly 22 is operable to form the cylinder block 24 as follows. With the tooling dies 28 held by the movable forming die 26 in the position shown, and with the cylinder liner tabs 38 are generally rotationally aligned with the head portions 52, the cylinder liners 32 are axially slid onto the mandrels 30 in the direction of arrows A in FIG. 1. In some examples the cylinder liners 32 can be manually slid onto the mandrels 30. In other examples, the cylinder liners 32 can be slid onto the mandrels 30 by a conventional robot, as such is well known in the art and thus not further described herein. Referring to FIGS. 4-6, the mandrel 30 and cylinder liner 32 are specially configured such that as the cylinder liner 32 is axially slid onto the mandrel 30, the first and second radial steps 42 engage with the corresponding first and second radial shoulders 54 on the mandrel 30 and funnel (rotate) the cylinder liner 32 into a seated position having a desired rotational (clocked) orientation. In particular, the second axial end 41 of the cylinder liner 32 is slid onto the mandrel 30 with the first and second cylinder liner tabs 38 generally radially aligned with the first and second head portions 52 on the mandrel 30. The cylinder liner 32 is axially slid down the mandrel 30 until the first and second radial steps 42 abut and slide along the radially outwardly-facing beveled surfaces 58. The cylinder liner 32 is further slid down the mandrel 30 until the first and second radial steps 42 are funneled by the side surfaces 60 of the first and second radial shoulders 54 into the seated position shown in FIGS. 4-6, wherein the first and second radial steps 42 abut the bottom surface 62. Thus it will be understood that engagement between the first and second radial steps 42 and the first and second radial shoulders 54 automatically clocks (i.e. rotationally orients relative to the axial direction) the cylinder liner 32 into a predetermined and precise clocked orientation for subsequent formation in place with the cylinder block 24. Referring to FIG. 5, optionally in the seated position the second axial end 41 of the cylinder liner 32 bottoms out on the mandrel 30 when it abuts an annular ridge 64 on the mandrel 30. This is shown in FIG. 6 at the second axial end 41.

Figure 7:
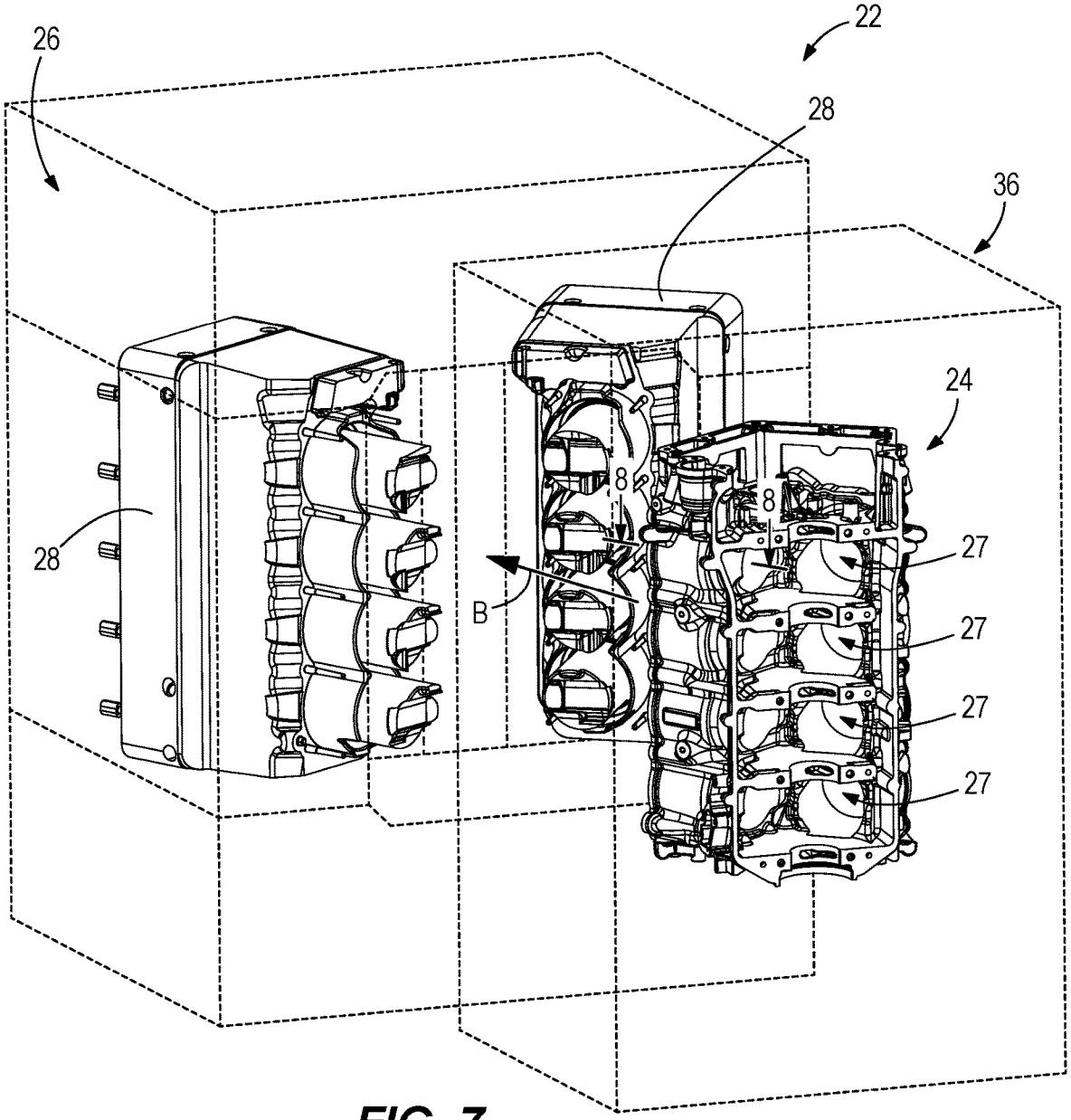
FIG. 7 is a view of the mold assembly and mandrels being withdrawn from a formed cylinder block containing the cylinder liners.

Referring to FIG. 7, once the cylinder liners 32 are in the seated position, the movable forming die 26 is brought into engagement with the stationary forming die 36 opposite the direction of arrow B. During this movement, the moveable forming die 26 typically vibrates and undergoes other changes in position that otherwise would cause the rotational orientation of the cylinder liners 32 to change, but for the restraining engagement between the radial steps 42 and radial shoulders 54. While the rotational orientation of the cylinder liners 32 remains constant, it is possible for movements of the movable forming die 26 to cause the cylinder liners 32 to move axially outwardly relative from the mandrels 30, however if that happens, as the first axial end 40 of the cylinder liner 32 enters the stationary forming die 36, the first axial end 40 is engaged by interior surfaces (not shown) of the stationary forming die 36 which during the forming process form the cylinder block 24 including the surfaces of cylinders 27 and caused to axially slide back down onto the mandrel 30 into the seated position, as funneling engagement between the radial steps 42 and radial shoulders 54 ensures that the rotational orientation of the cylinder liners 32 remains unchanged.

Figure 8:
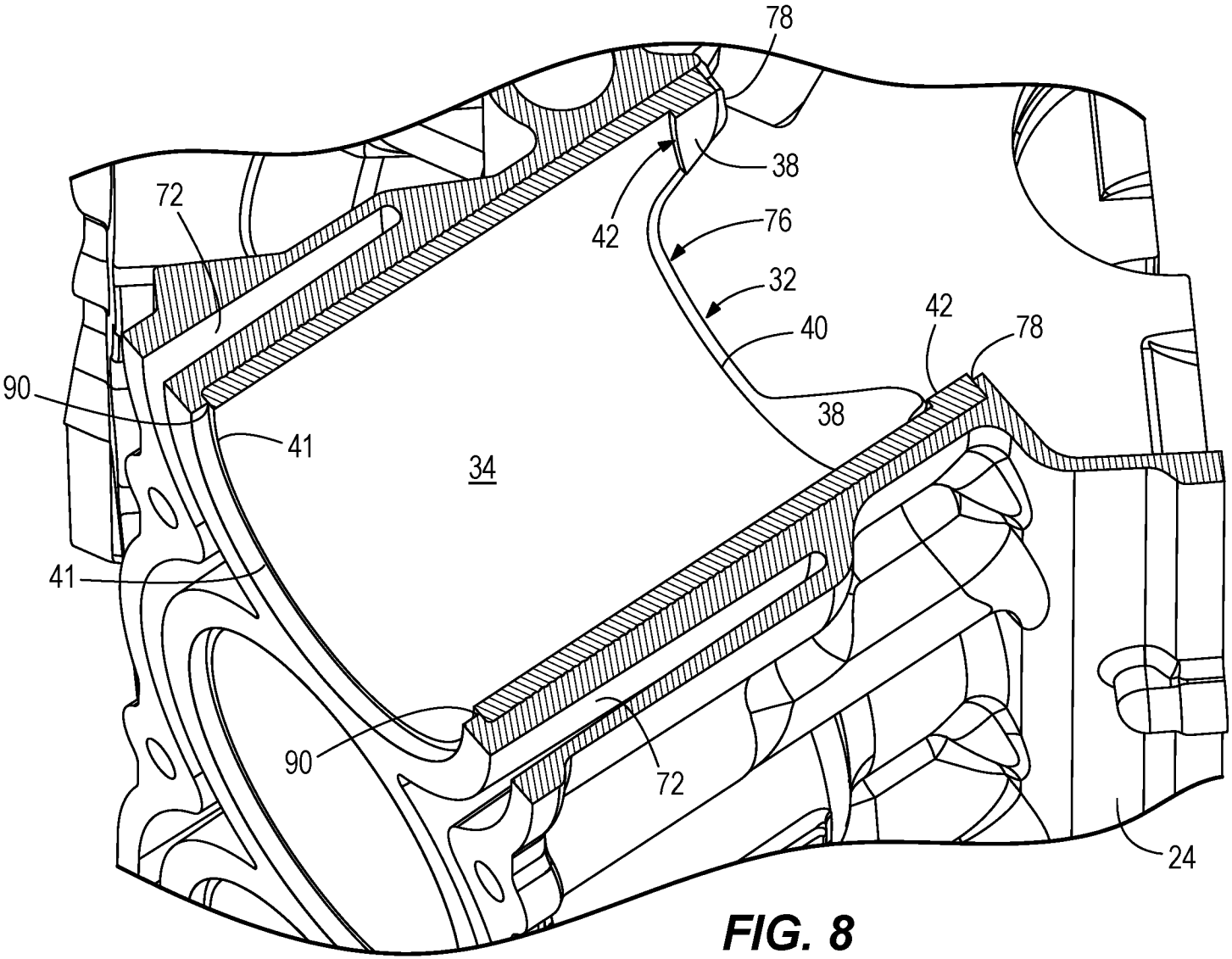
FIG. 8 is a view of section 8-8, taken in FIG. 7.
Figure 9:
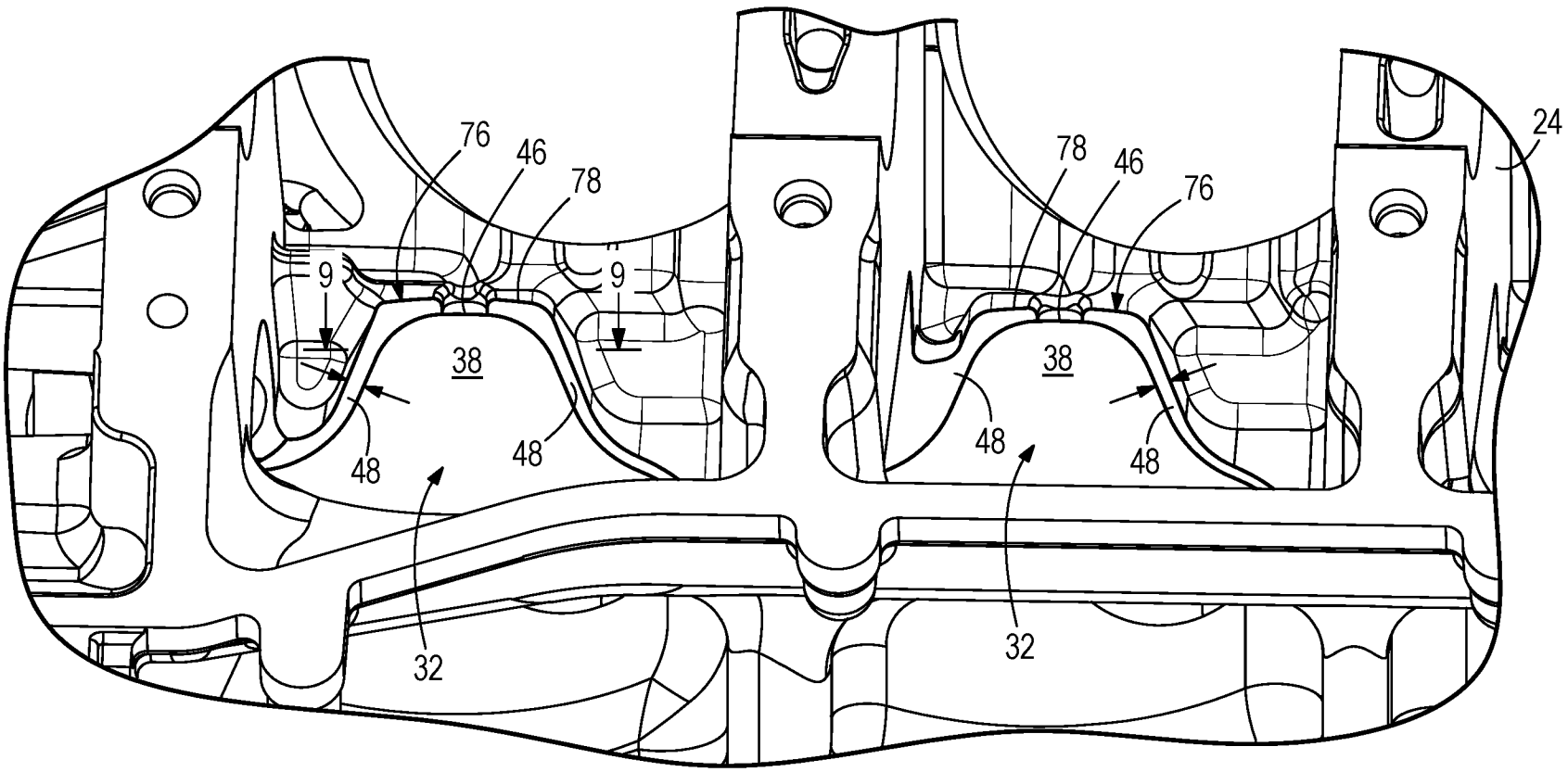
FIG. 9 is a perspective view showing engagement between the cylinder liners and a pocket formed in the cylinder block.
Figure 10:
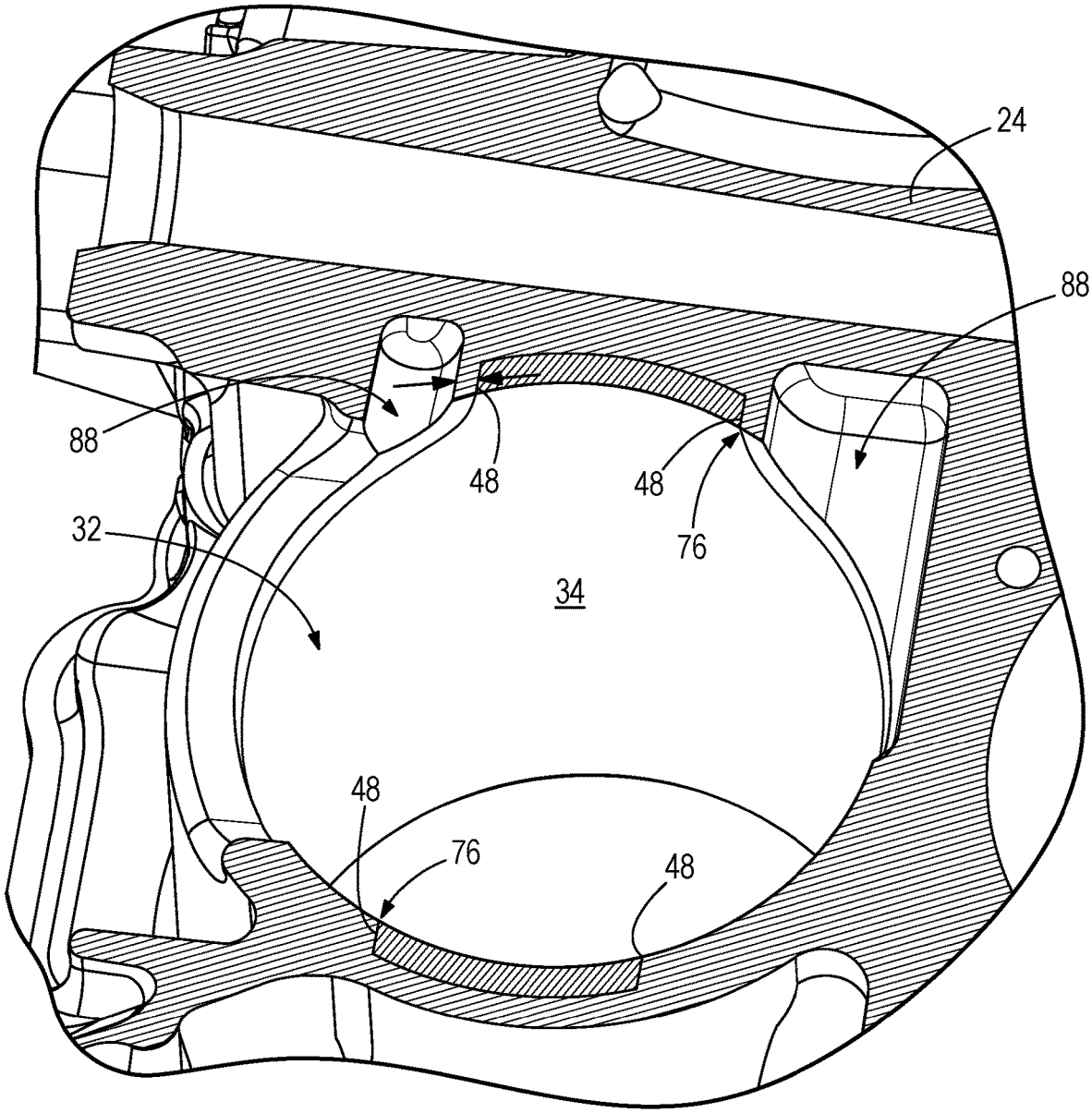
FIG. 10 is a view of section 9-9, taken in FIG. 9.

Once the movable forming die 26 and stationary forming die 36 are brought together, metal (in this example, aluminum) is cast into the mold assembly 22 while the cylinder liners 32 remain in place, and in the desired clocked orientation. As shown in FIGS. 8-10, aluminum that defines the cylinders 70 of the cylinder block 24 is cast around the cylinder liners 32 while the cylinder liners 32 remain in place. For example, aluminum for defining cooling jackets 72 around the cylinders 70 is cast around walls 74 (see FIGS. 2-3) of the tooling die 28, which are radially spaced apart from the mandrels 30. Next, referring to FIG. 7, the movable forming die 26 is moved back away from the stationary forming die 36 in the direction of arrow B, revealing the formed cylinder block 24 having the cylinder liners 32 formed in place in the desired clocked orientation in the cylinder bores 27. Thereafter, the radial steps 42 on each cylinder liner 32 are removed by a conventional milling process or any other suitable known machining process for providing a smooth inner diameter of the cylinder liners 32.

Referring to FIGS. 8-10, as a result of the above-described method, the cylinder liners 32 are formed in and are securely retained in a pocket 76 defined by the cylinder block 24. Advantageously, the pocket 76 retains the cylinder liner 32 in the desired clocked orientation, i.e., preventing the cylinder liner 32 from rotating about the center axis 33, thus ensuring that the tabs 38 remain in position to effectively provide a running surface for the pistons of the marine engine, as disclosed in the above-incorporated U.S. Pat. No. 10,233,862. More specifically, because the cylinder liner 32 is not axisymmetric and because the cylinder block 24 is cast in place in the cylinder liner 32, the resulting cylinder block 24 has the corresponding pocket 76 that follows the outer contours of the cylinder liner 32 and thus is not axisymmetric, having profile surfaces 78 that extend along the outer contours of the first and second cylinder liner tabs 38. Even more specifically, the first and second cylinder liner tabs 38 have outer contours that are defined by the above-described end surface 46 and opposing side surfaces 48. The resulting pocket 76 that is formed during casting of the cylinder block 24 around the cylinder liner 32 has corresponding first and second profile surfaces 78 that extend along and follow the outer contours of the first and second cylinder liner tabs 38, respectively. Thus engagement between the profile surfaces 78 and the first and second cylinder liner tabs 38 advantageously prevents rotational movement of the cylinder liner 32 about its center axis 33. In the example shown in FIG. 10, the profile surface 78 has an inner side that faces the outer contour of the liner body and an outer side that faces a cavity 88 in the cylinder block 24, which is provided for reducing the weight of the cylinder block 24.

The pocket 76 further advantageously prevents the cylinder liner 32 from moving axially relative to the center axis 33. Referring to FIG. 8, the pocket 76 has an annular end surface 90 that protrudes radially inwardly into the cylinder bore 27 and abuts the second end 41 of the cylinder liner 32. Together the first and second outer contours 82 and the end surface 90 of the pocket 76 retain the cylinder liner 32 in its axial position relative to the cylinder bore 27.

Figure 11:
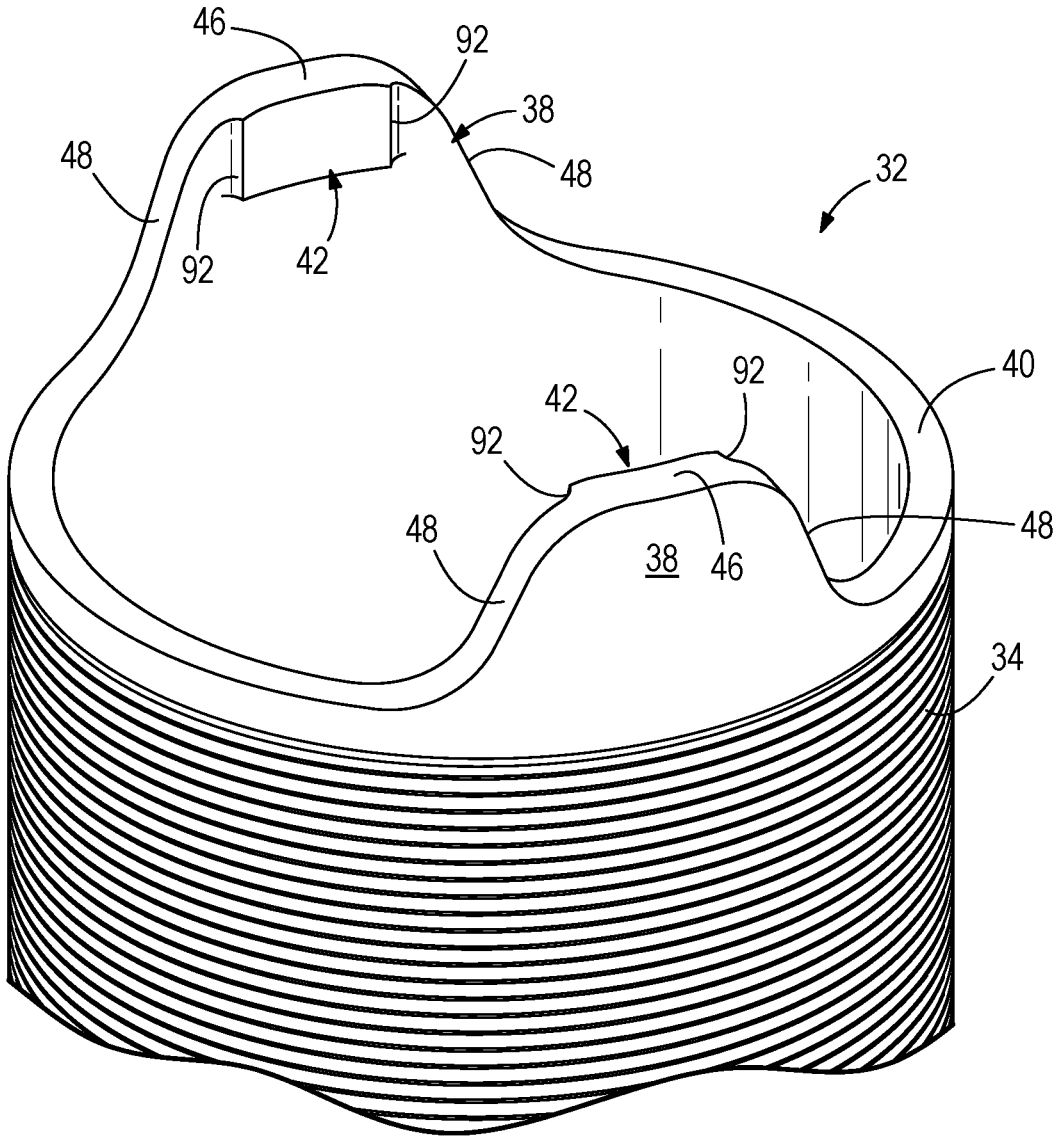
FIG. 11 is a perspective view of a cylinder liner according to a second embodiment of the present disclosure.

FIG. 11 depicts an alternate embodiment, in which the first and second radial steps 42 are spaced from and between the opposing side surfaces 48 of the respective first and second cylinder liner tab 38. The first and second radial steps 42 can be formed by milling, for example defining fillets 92 on both sides of the first and second radial steps 42.

The present disclosure thus provides a novel method for forming a marine engine that comprises providing a mold for forming a cylinder block; providing a mandrel configured for insertion into the mold prior to formation of the cylinder block so as to form a cylinder bore in the cylinder block; disposing a cylinder liner on the mandrel, the cylinder liner being configured to provide a running surface for a piston in the cylinder bore, the cylinder liner being further configured to engage with the mandrel as the cylinder liner is disposed on the mandrel so as to automatically clock the cylinder liner into a predetermined orientation in the cylinder block during formation thereof; and forming the cylinder block in the mold and around the mandrel and cylinder liner. In a non-limiting embodiment, the cylinder liner is iron and the cylinder block is formed out of aluminum.

In the present disclosure, certain terms have been used for brevity, clearness and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A cylinder liner configured to provide a running surface for a piston in a cylinder bore of a marine engine, the cylinder liner comprising: a liner body configured to fit in the cylinder bore, the liner body having a first end and a second end which is opposite the first end; at least one cylinder liner tab that axially extends from the second end of the liner body; and a radial step that radially extends from the cylinder liner tab and is configured to engage with a corresponding radial shoulder on a mandrel as the first end of the liner body is slid onto the mandrel, wherein engagement between the radial step and the radial shoulder automatically clocks the cylinder liner into a predetermined orientation in the marine engine during formation thereof.

2. The cylinder liner according to claim 1, wherein the cylinder liner tab is a first cylinder liner tab and further comprising a second cylinder liner tab that axially extends from the second end of the liner body and is diametrically opposite the first cylinder liner tab, wherein the radial step is a first radial step and wherein the radial shoulder is a first radial shoulder, and further comprising a second radial step that radially extends from the second cylinder liner tab and is configured to engage with a corresponding second radial shoulder on the mandrel during forming of the marine engine, wherein said engagement between the second radial step and the second radial shoulder further automatically clocks the cylinder liner into the predetermined orientation in the marine engine during formation thereof.

3. The cylinder liner according to claim 2, wherein the first radial step extends from an inner diameter of the first cylinder liner tab and wherein the second radial step extends from an inner diameter of the second cylinder liner tab.

4. The cylinder liner according to claim 3, wherein each of the first and second cylinder liner tabs comprises an axial end surface and a pair of opposing side surfaces that curve away from the axial end surface to the second end of the liner body.

5. The cylinder liner according to claim 4, wherein the first radial step extends to and between the pair of opposing side surfaces on the first cylinder liner tab and wherein the second radial step extends to and between the pair of opposing side surfaces on the second cylinder liner tab.

6. The cylinder liner according to claim 4, wherein the first radial step is spaced from and located centrally between the pair of opposing side surfaces on the first cylinder liner tab and wherein the second radial step is spaced from and located centrally between the pair of opposing side surfaces on the second cylinder liner tab.

7. An assembly for forming a marine engine, the assembly comprising: a mold for forming a cylinder block of the marine engine; a mandrel configured for insertion into the mold prior to formation of the cylinder block so as to form a cylinder bore in the cylinder block; and a cylinder liner configured to provide a running surface for a piston in the cylinder bore, the cylinder liner being elongated relative to an axis and being disposed on the mandrel during formation of the cylinder block in the mold, wherein the cylinder liner and the mandrel are configured to engage with each other when the cylinder liner is axially slid onto the mandrel so as to automatically clock the cylinder liner relative to the axis into a predetermined orientation for formation of the cylinder block.

8. An assembly for forming a marine engine, the assembly comprising: a mold for forming a cylinder block of the marine engine; a mandrel configured for insertion into the mold prior to formation of the cylinder block so as to form a cylinder bore in the cylinder block; and a cylinder liner configured to provide a running surface for a piston in the cylinder bore, the cylinder liner being disposed on the mandrel during formation of the cylinder block in the mold, wherein the cylinder liner and the mandrel engage with each other when the cylinder liner is slid onto the mandrel so as to automatically clock the cylinder liner into a predetermined orientation in the cylinder block during formation thereof, wherein the cylinder liner comprises a radial step that radially inwardly extends from the cylinder liner and is configured to engage with a corresponding radial shoulder on the mandrel during forming of the marine engine, wherein engagement between the radial step and the radial shoulder when the cylinder liner is slid onto the mandrel automatically clocks the cylinder liner into the predetermined orientation.

9. An assembly for forming a marine engine, the assembly comprising: a mold for forming a cylinder block of the marine engine; a mandrel configured for insertion into the mold prior to formation of the cylinder block so as to form a cylinder bore in the cylinder block; and a cylinder liner configured to provide a running surface for a piston in the cylinder bore, the cylinder liner being disposed on the mandrel during formation of the cylinder block in the mold, wherein the cylinder liner and the mandrel engage with each other when the cylinder liner is slid onto the mandrel so as to automatically clock the cylinder liner into a predetermined orientation in the cylinder block during formation thereof, wherein the cylinder liner comprises a liner body configured to fit in the cylinder bore, diametrically opposing first and second cylinder liner tabs that axially extend from an end the liner body, and a radial step that radially inwardly extends from the first cylinder liner tab and is configured to engage with a corresponding radial shoulder on a mandrel during forming of the marine engine, wherein engagement between the radial step and the radial shoulder when the cylinder liner is slid onto the mandrel automatically clocks the cylinder liner into the predetermined orientation.

10. The assembly according to claim 9, wherein the radial step is a first radial step and wherein the radial shoulder is a first radial shoulder, and further comprising a second radial step that radially inwardly extends from the second cylinder liner tab and is configured to engage with a corresponding second radial shoulder on the mandrel during forming of the marine engine, wherein said engagement between the second radial step and the second radial shoulder further automatically clocks the cylinder liner into the predetermined orientation.

11. The assembly according to claim 10, wherein the first radial step extends along an inner diameter of the first cylinder liner tab, wherein the second radial step extends along an inner diameter of the second cylinder liner tab, and wherein each of the first and second cylinder liner tabs comprises an end surface and a pair of opposing side surfaces that curve away from the end surface to the second end of the liner body.

12. The assembly according to claim 11, wherein the first radial step extends to and between the pair of opposing side surfaces on the first cylinder liner tab and wherein the second radial step extends to and between the pair of opposing side surfaces of the second cylinder liner tab.

13. The assembly according to claim 11, wherein the first radial step is spaced from and located centrally between the pair of opposing side surfaces on the first cylinder liner tab and wherein the second radial step extends centrally between the pair of opposing side surfaces of the second cylinder liner tab.

14. The assembly according to claim 8, wherein the radial shoulder funnels the radial step into a seated position as the cylinder liner is axially slid onto the mandrel.

15. The assembly according to claim 14, wherein the radial shoulder comprises a pair of opposing side surfaces and a bottom surface that extends between the side surfaces and wherein the side surfaces are tapered relative to each other so as to funnel the radial step into the seated position.

16. A method for forming a cylinder block of a marine engine, the method comprising: providing a mold assembly for forming the cylinder block; providing a mandrel for forming a cylinder bore in the cylinder block; disposing a cylinder liner on the mandrel, the cylinder liner being elongated relative to an axis and being configured to provide a running surface for a piston in the cylinder bore, the cylinder liner being further configured to engage with the mandrel as the cylinder liner is axially disposed on the mandrel so as to automatically clock the cylinder liner relative to the axis into a predetermined orientation for formation of the cylinder block; and forming the cylinder block in the mold and around the mandrel and cylinder liner.

17. The method according to claim 16, comprising axially sliding of the cylinder liner onto the mandrel.

18. The method according to claim 17, wherein the cylinder liner engages the mandrel so as to automatically clock the cylinder liner into the predetermined position.

19. The method according to claim 18, wherein the mold comprises a first forming die and a second forming die, wherein the mandrel is located with the first forming die, and further comprising moving of the first forming die and the mandrel into engagement with the second forming die during which the mandrel maintains the cylinder liner in the predetermined orientation.

20. The method according to claim 19, wherein the cylinder liner is iron and further comprising forming the cylinder block out of aluminum while the cylinder liner is in the predetermined orientation on the mandrel.

* * * * *